US006056611A

United States Patent [19]

House et al.

[11] Patent Number: 6,056,611

[45] Date of Patent: May 2, 2000

[54] INTEGRATED INDUCTION NOISE SILENCER AND OIL RESERVOIR

[75] Inventors: Ian G. House; Michael A. Freund; David W. Kusche, all of Oshkosh, Wis.

[73] Assignee: Brunswick Corporation, Lake Forest, Ill.

[21] Appl. No.: 09/311,020

[22] Filed: May 13, 1999

[51] Int. Cl.[7] ..... B63H 21/10

[52] U.S. Cl. ..... 440/88; 181/229

[58] Field of Search ..... 440/88, 89; 181/214, 181/229

[56] References Cited

U.S. PATENT DOCUMENTS

| | | | |
|---|---|---|---|
| 4,215,664 | 8/1980 | Hatz | 123/195 |
| 4,569,415 | 2/1986 | Breckenfeld et al. | 181/29 |
| 4,570,744 | 2/1986 | Hoshiba | 181/204 |
| 4,730,695 | 3/1988 | Bar | 181/252 |
| 4,846,300 | 7/1989 | Boda | 181/229 |
| 5,373,824 | 12/1994 | Peters et al. | 123/527 |
| 5,487,687 | 1/1996 | Idzikowski et al. | 440/77 |
| 5,487,688 | 1/1996 | Sumigawa | 440/88 |
| 5,554,058 | 9/1996 | LeQuire | 440/89 |
| 5,683,277 | 11/1997 | Tsunoda et al. | 440/88 |
| 5,719,358 | 2/1998 | Lindholm | 181/235 |

*Primary Examiner*—Stephen Avila
*Assistant Examiner*—Andrew D. Wright
*Attorney, Agent, or Firm*—William D. Lanyi

[57] ABSTRACT

An oil reservoir is used as a sound attenuator in an outboard motor and is placed under the cowl of the outboard motor with the throats of the engine's throttle bodies disposed between the oil reservoir and the engine itself. This allows the sound emanating from the throttle bodies to be attenuated by the oil reservoir which is cup-shaped to partially surround the throat of the throttle bodies. A plate member can be attached to a hollow wall structure in order to enclose a cavity therebetween. The structure therefore serves as an oil reservoir for the engine and also as a sound attenuating member.

19 Claims, 10 Drawing Sheets

INTEGRATED INDUCTION NOISE SILENCER AND OIL RESERVOIR

BACKGROUND OF THE INVENTION

1. Field of the Invention

The present invention is generally related to oil reservoirs and to induction noise silencing components and, more particularly, to an oil reservoir which is shaped for use as an induction noise silencer for an internal combustion engine.

1. Description of the Prior Art

Many different components and parts of an internal combustion engine generate vibration and noise. In addition to the reciprocating pistons, which can create vibration in the engine, and the exhaust stream of rapidly moving hot gases, the air induction system of an engine can be one of the most significant sources of noise. Air must be drawn into the one or more throttle bodies of the engine for use in the combustion and scavenging processes. Whether the internal combustion engine is carbureted or fuel injected, large quantities of air must be inducted into the combustion chambers.

As ambient air is drawn toward and into the one or more throttle bodies, noise is created. In addition, sound produced by the internal components of the engine can be emitted through the throttle bodies because, in most cases, the throats of the throttle bodies represent the most direct and least impeded path for the noise to travel from the internal components of the engine to the region surrounding the engine.

Many types of internal combustion engines are provided with oil tanks, or reservoirs, in which a quantity of oil is stored for use by the engine. In some situations, such as in certain outboard motors for marine use, an oil tank is located under the cowl which covers the engine. In some applications, the oil reservoir under the cowl operates as a holding tank and is connected in liquid communication between the engine and a larger oil tank located elsewhere on the marine vessel.

In the design of outboard motors, the space under the cowl of the outboard motor is very limited. In known outboard motors, some of this valuable space under the cowl must be used for the oil reservoir and other valuable space must be used for some type of noise silencer located near the one or more throttle bodies in order to attenuate the noise emanating from the throttle bodies.

In systems known to those skilled in the art, many different techniques and processes have been used to reduce the noise of internal combustion engines and, more specifically, outboard motors. Also, many different designs of oil reservoirs are known to those skilled in the art of internal combustion engines and outboard motors.

U.S. Pat. No. 5,487,688, which issued to Sumigawa on Jan. 30, 1996, describes an outboard motor and several embodiments which embody four cycle engines having an oil tank that is contained within the driveshaft housing and which is surrounded at least in part by a water cooling jacket for maintaining the oil at an acceptable temperature. The oil tank is formed with a cavity through which an exhaust pipe passes and the area between the exhaust pipe and the oil tank forms, in at least some embodiments, an expansion chamber for silencing the exhaust gases. At least part of the exhaust pipe and/or expansion chamber is also cooled by a water jacket.

U.S. Pat. No. 5,373,824, which issued to Peters et al on Dec. 20, 1994, describes an acoustical damping device for gaseous fueled automotive engines. The fuel supply system for a gaseous fueled automotive engine is provided for means for damping pressure waves occurring within the fuel line between the fuel tank and the engine. In a preferred embodiment, acoustical barriers, such as annular rings, are secured to the inside of the fuel rail for partially transmitting and partially reflecting the pressure waves so that wave amplitude is decreased. An alternative embodiment comprises an acoustical barrier in the fuel line having an cylindrical section with a diameter larger than that of the fuel line. Baffles, possibly annular rings, within the cylindrical section also serve to damp the pressure waves. The acoustical barrier may also be composed of a conical section with diameters equal to that of the cylindrical section on one end and the fuel line at the other end. Acoustical barriers placed in both the fuel line and fuel rail also effectively damp the pressure waves.

U.S. Pat. No. 4,215,664, which issued to Hatz on Aug. 5, 1980, discloses an internal combustion engine with a sound-proofing shell. In order to compensate for positional variations during assembly or in use between an engine body or crankcase and a sound-proofing shell enclosing the same, use is made of interposed spring arrangements including a load-setting means.

The above described patents are hereby expressly incorporated by reference in this description.

It would be significantly beneficial if a means could be provided to combine the functions of oil storage under the cowl and noise silencing under the cowl into a single component or structure. This would perform both individual functions while also significantly reducing the required space under the cowl of an outboard motor.

SUMMARY OF THE INVENTION

A sound attenuation system for an internal combustion engine, made in accordance with a preferred embodiment of the present invention, comprises an engine and a throttle body through which air can pass as it flows toward a combustion chamber located within the engine. It should be understood that the throttle body could be incorporated as part of either a carbureted fuel system or a fuel injection system of the engine.

An oil reservoir is provided with a hollow wall that is shaped to receive and contain a quantity of oil therein. The throttle body is disposed between the engine and the hollow wall of the oil reservoir and also between the engine and the quantity of oil when the quantity of oil is disposed within the oil reservoir. Naturally, the oil contained within the hollow wall of the oil reservoir is intended to be used during operation of the engine. When the oil reservoir of the present invention is used as an intermediate oil tank, it will remain filled as long as the primary oil tank is not empty. If the oil reservoir of the present invention is used as a primary, and sole, oil tank, the oil within the reservoir will be gradually depleted as the oil is used by the engine. Therefore, at various times during the operation of the engine, the oil reservoir can be virtually filled or, in other instances, only partially filled with oil. However, the hollow wall of the reservoir where the oil is stored is located so that the throttle body is between it and the engine. This location of the hollow wall will therefore place the oil itself at a location under the cowl so that the throttle body is between the oil and the engine when the hollow wall contains oil.

A particularly preferred embodiment of the present invention further comprises four hollow side walls that are attached to the hollow wall at the edges of the hollow wall.

The four hollow side walls can extend from the hollow wall in a direction toward the engine. When the four hollow side walls extend from the hollow wall, they form a cup-shaped concave structure. A plate member, which can be either flat in certain embodiments of the present invention, but need not be flat in all embodiments, can be attached to the hollow wall and/or the four hollow side walls to define a partially enclosed cavity therebetween.

An air inlet can be formed through the plate member through which ambient air can flow into the cavity and an air outlet can be formed through the plate member through which air can flow from the cavity toward the throttle body. A support bracket can be attached between the engine and the oil reservoir to maintain the oil reservoir in a desired position relative to the engine. In a particularly preferred embodiment of the present invention, at least a portion of the throttle body extends into the cavity and through the plate member. This places the distal end of the throttle body structure within the cavity formed by the hollow wall, the four hollow side walls, and the plate member.

The engine used in conjunction with the sound attenuation system of the present invention can be a portion of a marine propulsion system and, more specifically, it can be an outboard motor with the oil reservoir disposed under the cowl of the outboard motor. However, it should be clearly understood that the present invention can be used with other types of sound producing machinery other than internal combustion engines. In addition, the contents of the reservoir need not be oil in all applications. Other liquids, such as water, gasoline, or antifreeze solutions, will also produce the beneficial sound attenuating effects of the present invention.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
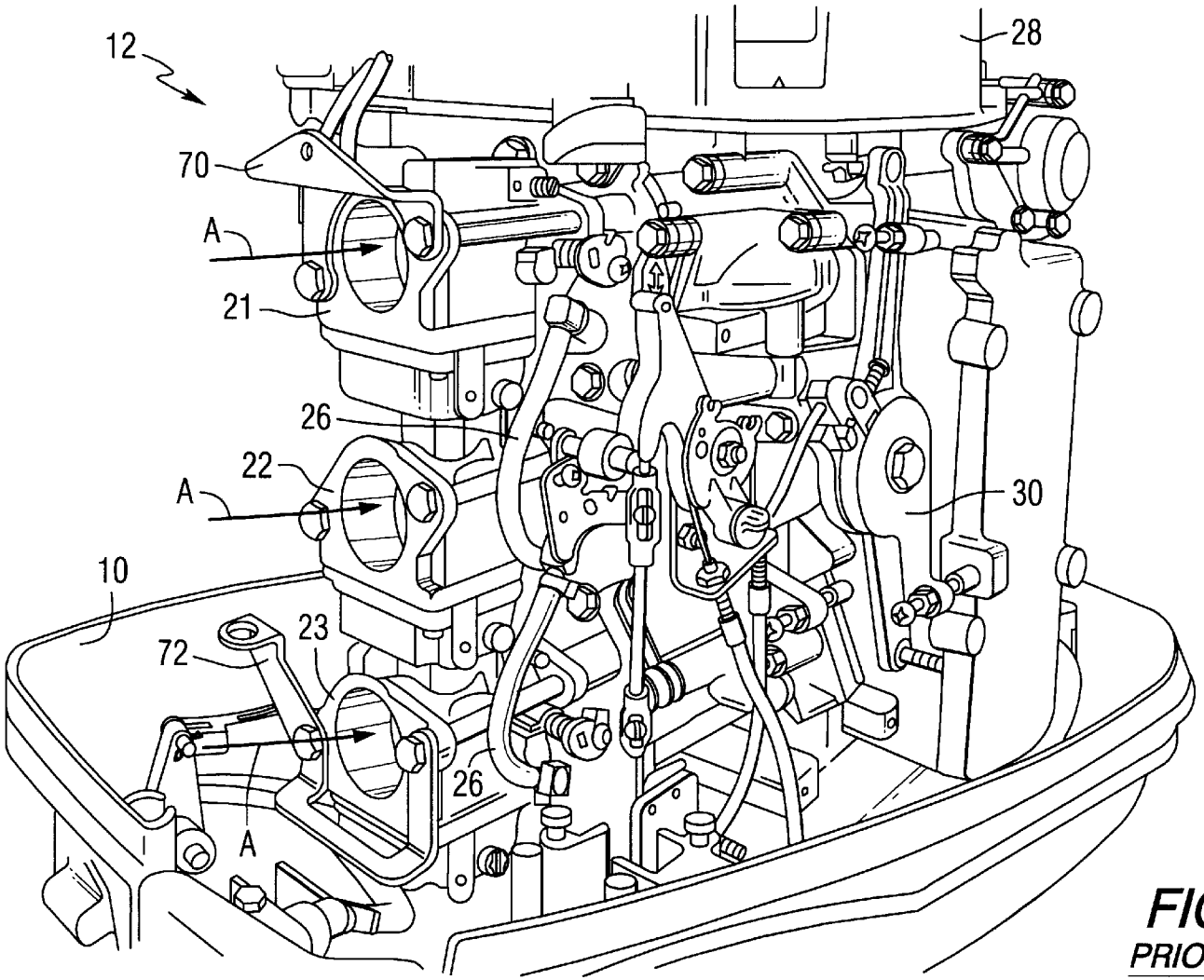
FIG. 1 PRIOR ART
FIG. 1 is an isometric view of a known outboard motor engine.

Throughout the description of the preferred embodiment of the present invention, like components will be identified by like reference numerals.

FIG. 1 shows an isometric view of a known type of outboard motor engine. The removable cowl is not shown, but a lower cowl 10 is illustrated in FIG. 1. The internal combustion engine 12 is shown in FIG. 1 as having three throttle bodies, 21–23. Also shown in FIG. 1 are several fuel lines 26, a flywheel cover 28, and a throttle lever 30.

Arrows A show the direction in which air travels as it flows into the throats of the throttle bodies 21–23. This air is used in the combustion and scavenging processes of the engine 12. The passage of air into the throttle bodies creates noise and, in some instances, it is the most significant source of noise from the engine 12. In addition, sound produced within the structure of the engine 12 can emanate from the throats from the throttle bodies 21–23. As a result, the throttle bodies represent a significant source of noise from the engine.

Figure 2:
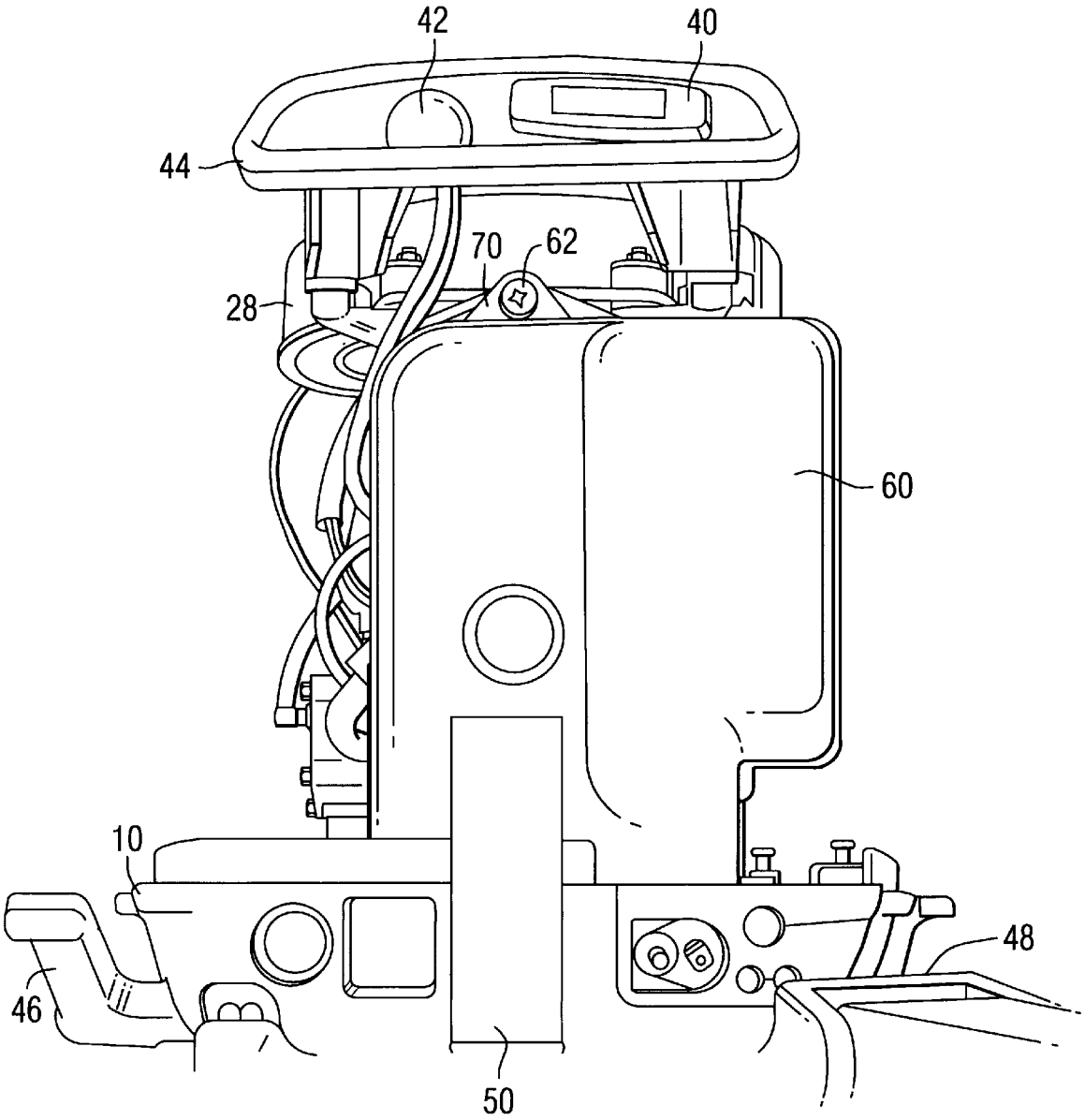
FIG. 2 PRIOR ART
FIG. 2 is a front view of the engine shown in FIG. 1.

FIG. 2 shows a front view of the engine illustrated in FIG. 1. FIG. 2 also shows a starter handle 40, a primer bulb 42, a seal 44, a shift lever 46, a tiller handle 48, a cowl latch 50, and a sound attenuator 60. The sound attenuator 60, or attenuator cover is used to block the direct emanation of sound from the throttle bodies 21–23 which, in this particular example, are three carburetors. The sound attenuator 60 is attached, by one or more screws 62, two brackets which are, in turn, attached to the engine 12. With reference to FIGS. 1 and 2, brackets 70 and 72 are used to attach the sound attenuators 60 to the engine.

With reference to FIGS. 1 and 2, it can be seen that the sound attenuator 60 is located at a position that places the three throttle bodies 21–23, between the sound attenuator 60 and the block and head of the engine 12. As sound emanates from the throttle bodies 21–23, the sound attenuator 60 blocks the direct passage of that sound from the throttle bodies and also attenuates the noise. It is generally known that sound attenuators 60 can be used for these purposes by placing the sound attenuator 60 in front of the throttle bodies 21–23 in the manner described immediately above.

Figure 3:
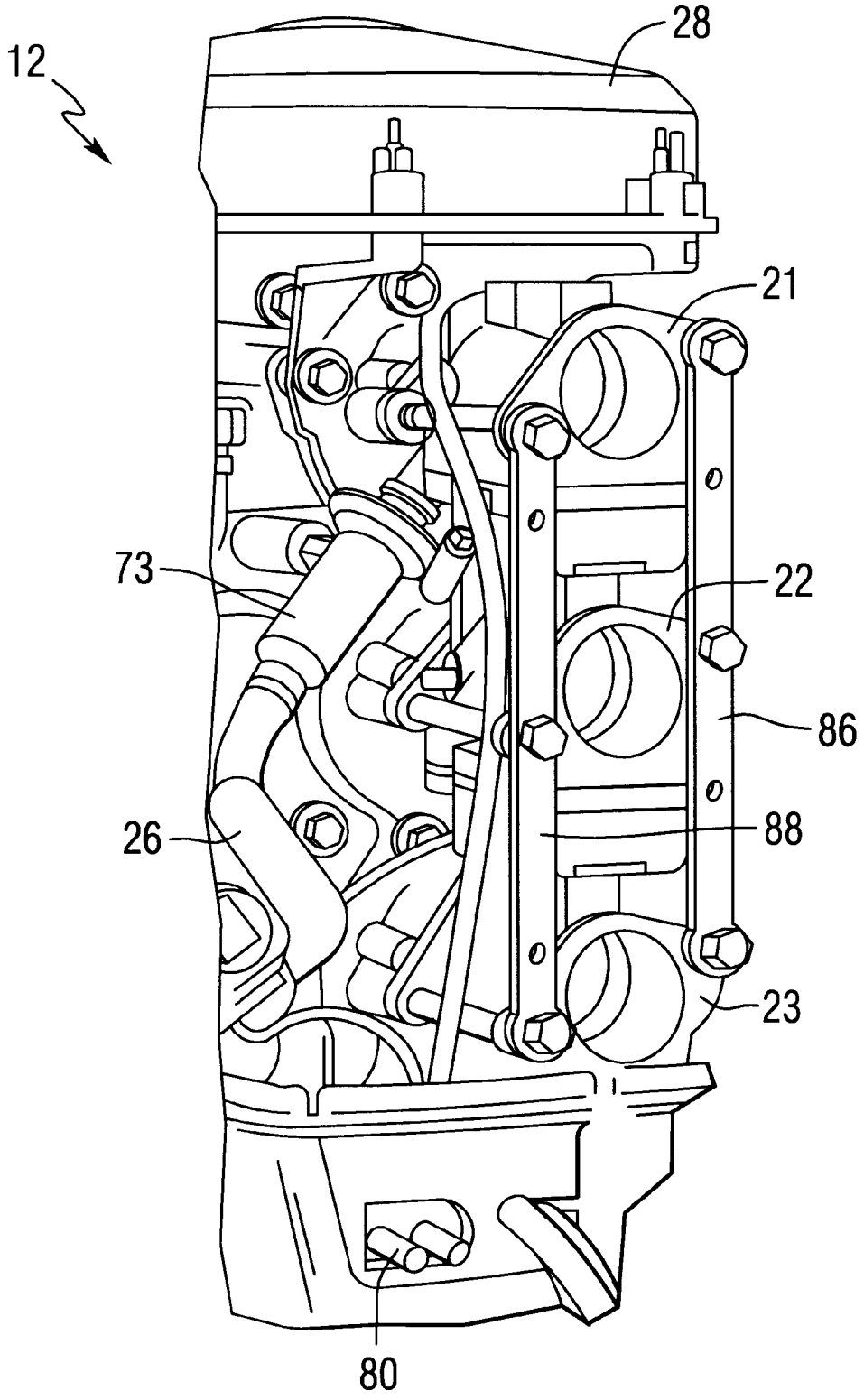
FIG. 3 PRIOR ART
FIG. 3 is a isometric view of another known type of outboard motor.

FIG. 3 is a partial isometric view of another engine 12 in which three throttle bodies 21–23, which are carburetors, are attached to the block of the engine 12. FIG. 3 also shows a flywheel cover 28, a fuel filter 73, a fuel line 26, a fuel connector 80, and brackets, 86 and 88.

The throttle bodies 21–23 in FIG. 3 are a source of noise because of the reasons described above in conjunction with the description of the throttle bodies 21–23 in FIG. 1.

Figure 4:
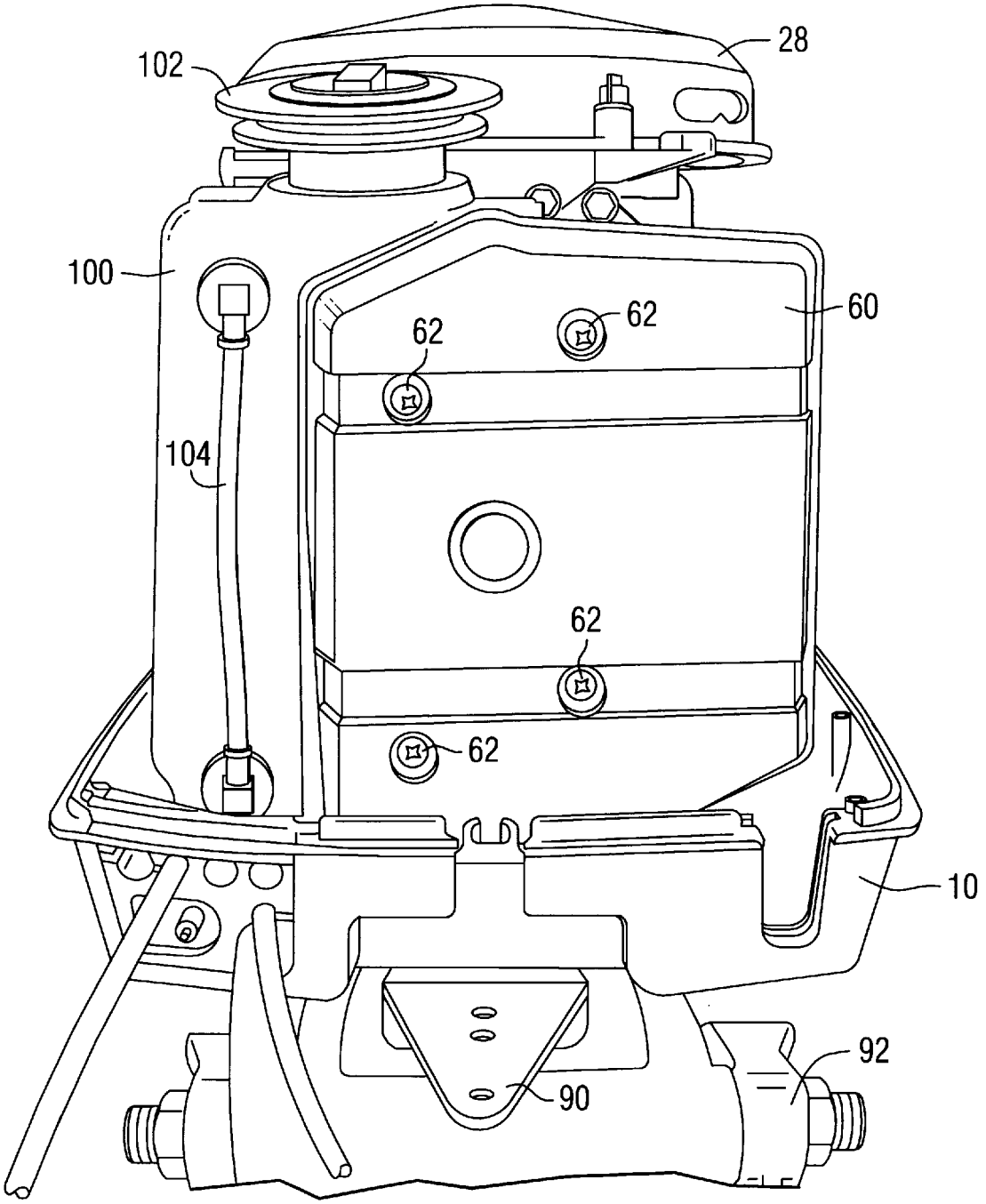
FIG. 4 PRIOR ART
FIG. 4 is a frontal view of the engine of FIG. 3.

FIG. 4 shows a front view of the same engine that is shown in FIG. 3. The lower cowl 10, a steering arm bracket 90, a swivel bracket 92, and the flywheel cover 28 are also shown in FIG. 4. A sound attenuator 60 is attached to brackets which are, in turn, attached to the engine. The screws 62 are used to attach the sound attenuator 60 to the brackets, 86 and 88, shown in FIG. 3.

FIG. 4 also illustrates an oil reservoir 100 with a fuel cap 102 and a sight gauge 104. The oil reservoir 100 contains a preselected quantity of oil that is used, for purposes of lubrication, during operation of the engine.

With reference to FIGS. 3 and 4, it can be seen that valuable space within the structure of the outboard motor and under the cowl is required to contain the sound attenuator 60 and the oil reservoir 100. This known arrangement represents a severe disadvantage for several reasons. First, space under the cowl is significantly limited. In addition, known forms of sound attenuators 60 used in conjunction with outboard motors are typically a single thickness plastic member that is shaped, as illustrated in FIGS. 2 and 4, to be placed in front of the throttle bodies 21–23. These sound attenuators 60 provide a sound baffle which are intended to attenuate the noise emanating from the throats of the throttle bodies 21–23, but they are not totally effective in doing so. It would therefore be significantly beneficial if a more effective sound attenuating system could be provided and, furthermore, it would be beneficial if the requirement for both a sound attenuator 60 and an oil reservoir 100 could be satisfied with one structure which could provide both functions for the outboard motor.

Figure 5:
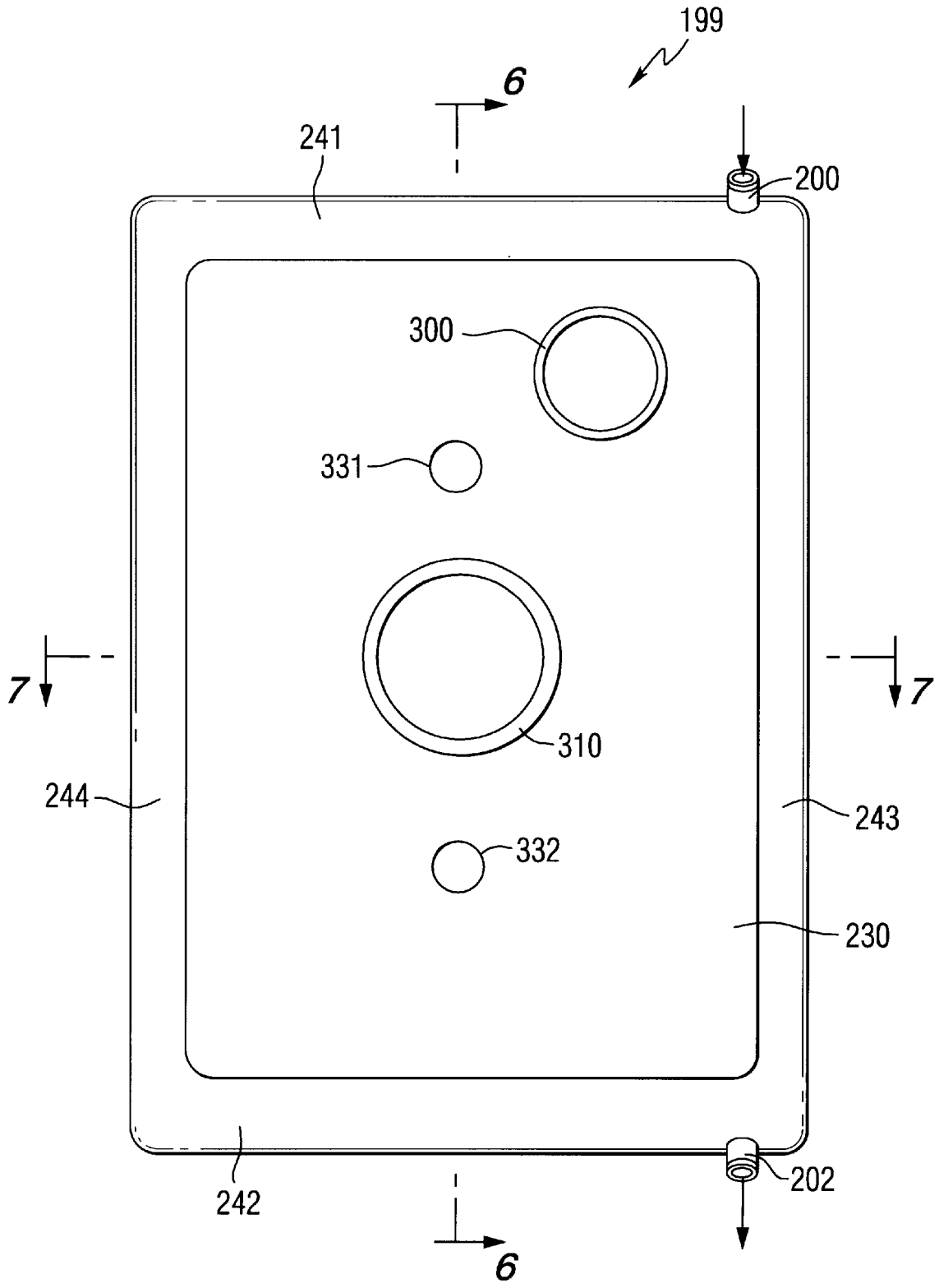
FIGS. 5, 6 and 7 are three views of the present invention.
Figure 6:
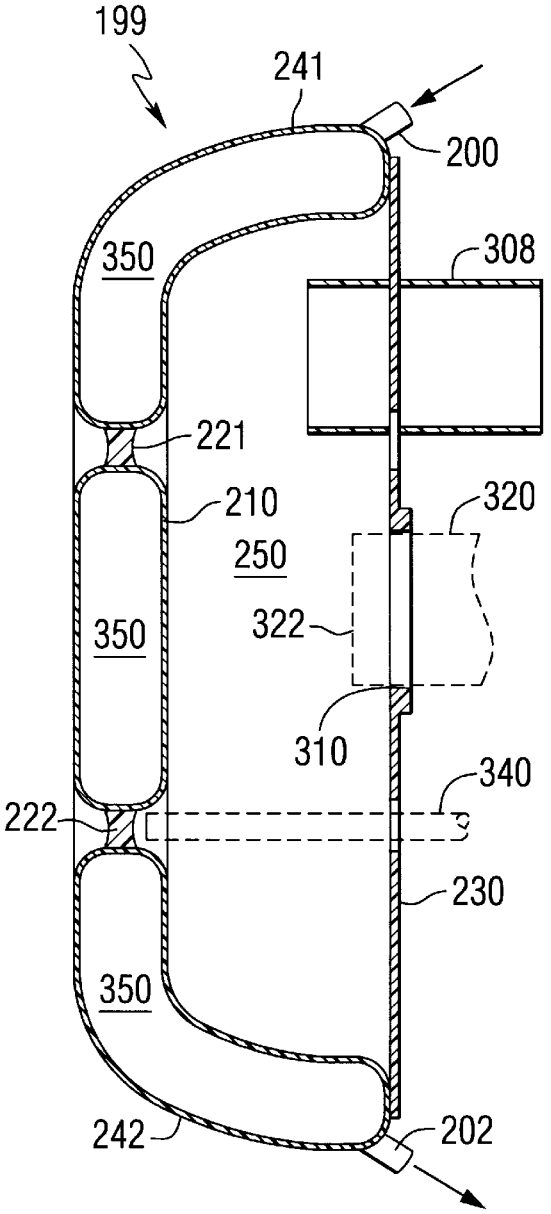

FIG. 5 is a front view of an integrated induction noise silencer and oil reservoir 199 made in conjunction with the present invention. The structure shown in FIG. 5 has an oil inlet 200 and an oil outlet 202 which allows oil to flow through the oil reservoir 199 as represented by the relevant arrows in FIG. 5. The oil reservoir 199 is provided with a hollow wall, not visible in FIG. 5, which is shaped to receive and contain a quantity of oil therein. FIG. 6 is a sectional view of the oil reservoir shown in FIG. 5. In FIG. 6, the hollow wall 210 is provided with two dimples, 221 and 222, which represent a localized solid plastic portion through which screws can be driven for mounting the oil reservoir 199. A plate member 230 is attached to the oil reservoir 199. Throughout the description of the present invention, the term "hollow wall" will be used to describe the sound blocking structures which are capable of containing a liquid, such as fuel, or a gas, such as air or vapor. In certain embodiments of the present invention, these structures may not always appear as "walls", but as alternatively shaped elements. Furthermore, this term is intended to describe a cavity, between two solid sheets or plates, which can be used to block the path of sound and attenuate its magnitude.

Figure 7:
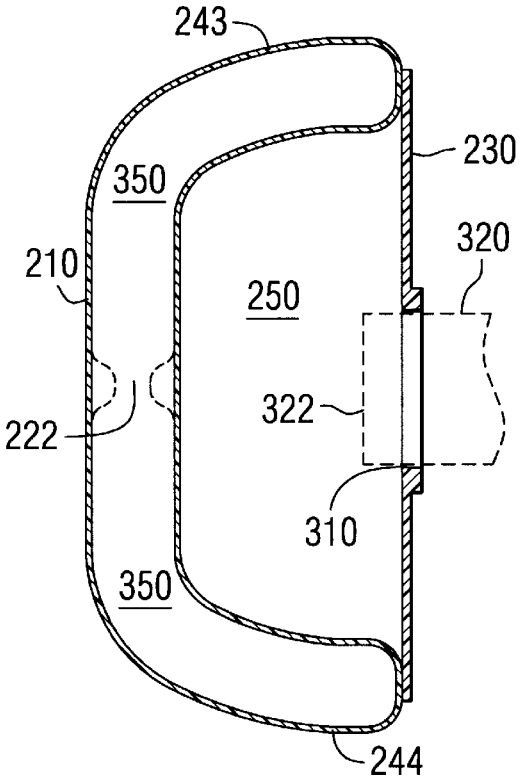

In FIG. 6, two of the four hollow side walls are shown. They are identified in FIG. 6 by reference numerals 241 and 242. In FIG. 7,which is a sectional view of the oil reservoir shown in FIG. 5, two other hollow side walls, 243 and 244, are shown. With reference to FIG. 6 and 7, it can be seen that the four hollow side walls 241–244, are attached to the hollow wall 210 at its edges. In addition, the four hollow side walls 241–244 extend from the hollow wall 210 in a direction which partially defines a cavity 250. The plate member 230 is attached to the four hollow side walls 241–244 to further define the cavity 250 between the plate member 230 and the various hollow walls.

With reference to FIGS. 5, 6, and 7, it can be seen that the plate member 230 is provided with several openings. An air inlet 300 is formed through the plate member 230 to allow ambient air to flow into the cavity 250. A tubular extension 308 can be used to further direct the air from the region surrounding the engine and under the cowl to the cavity 250 of the present invention. The tubular extension 308 also serves the purpose of further attenuating the sound that emanates from the engine. An air outlet 310 is formed through the plate member 230 to allow air to pass from the cavity 250 into a throttle body of the engine. In FIG. 6, dashed line 320 represents a possible location of the distal end of a throttle body in relation to the plate member 230. A tubular portion of the throttle body can extend into the cavity 250. Alternatively, the distal end 322 of the throttle body throat can remain outside the cavity 250, but in general alignment relation with the air outlet 310.

Two access holes, 331 and 332 are illustrated in FIG. 5. These holes are intended to allow rods, such as the one represented by dashed lines 340 in FIG. 6, to pass through them so that a screw can be driven through the solid plastic portion of the dimple 222 to attach the oil reservoir 199 to the engine. The rod 340 would be used as a bracket for these purposes and would also be rigidly attached to the engine.

With reference to FIGS. 5, 6 and 7, the illustrated oil reservoir 199 is intended to act as an intermediary oil tank between the engine and a larger oil reservoir located elsewhere in a marine vessel. As such, it will always be filled with oil as long as its associated primary oil tank is not empty. As such, the cavities 350 which are all joined together in fluid communication with each other, are generally filled with oil. As oil is taken from the cavities 350 for use by the engine, additional fill oil flows into the oil inlet 200. The oil reservoir of the present invention can also be used as a primary, or sole, oil tank, as described above.

In a preferred embodiment of the present invention, the oil reservoir 199 is made of plastic that is formed to provide a hollow reservoir, or oil tank, which comprises a primary hollow wall 210 and a plurality of hollow side walls 241–244. Oil can be contained within cavities 350 in all of the hollow walls of the oil reservoir 199.

Figure 8:
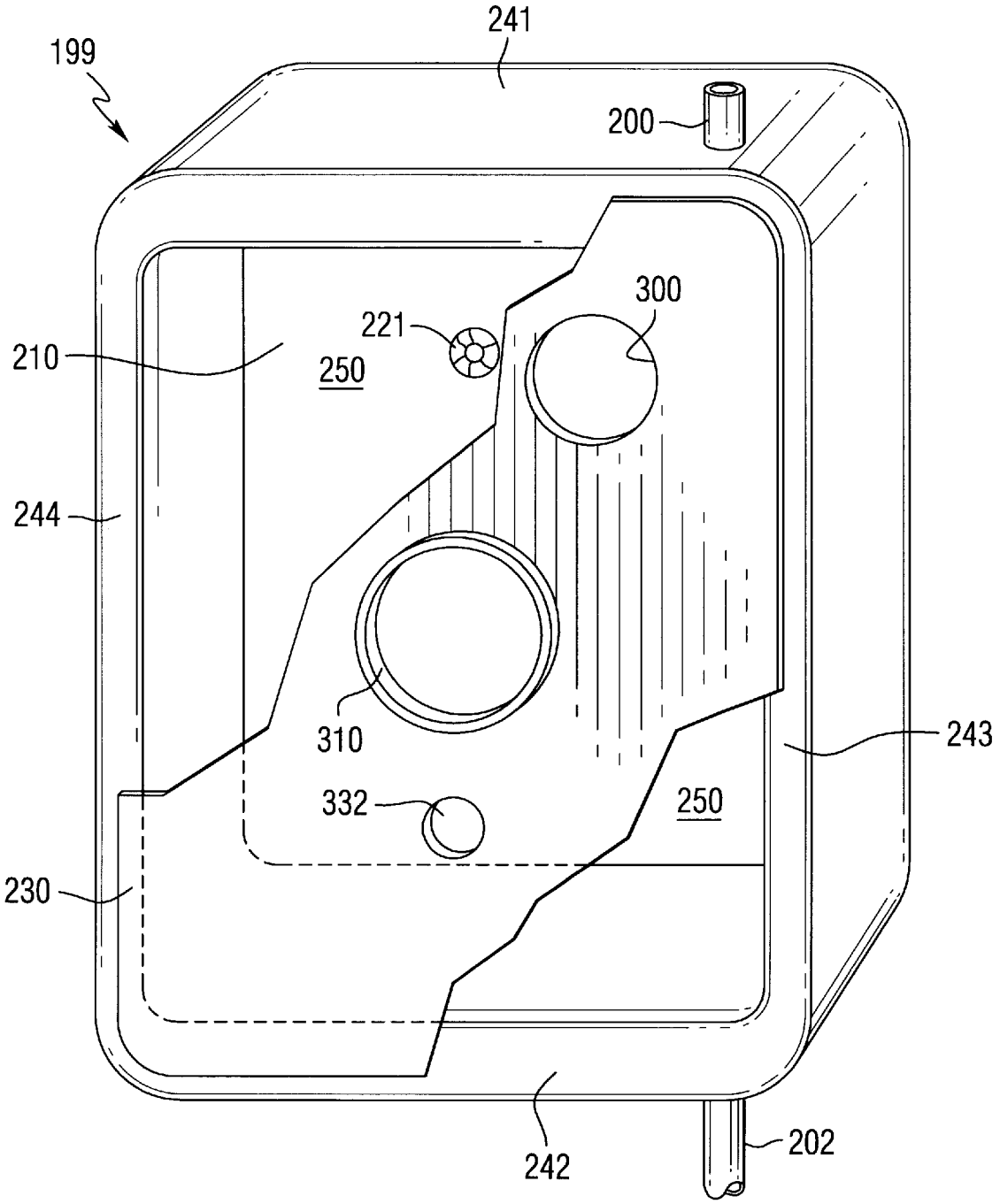
FIG. 8 is an isometric view of the present invention.

FIG. 8 is an isometric view of the oil reservoir 199 showing the hollow wall 210, the four hollow side walls 241–244, the plate member 230, the oil inlet 200 and the oil outlet 202. The plate member 230 in FIG. 8 is shown partially removed to expose the cavity 250. The air inlet 300 and air outlet 310 are openings formed through the plate member 230. Air flows from the region surrounding the engine into the cavity 250 through the air inlet 300 and flows from the cavity 250 toward the throat of a throttle body through the air outlet 310. The dimple 221 is shown formed in the hollow wall 210 and the hole 332 is shown formed through the plate member 230. As described above in conjunction with FIG. 6, hole 332 allows a bracket rod 340 to extend into the cavity 250 to be attached, by a screw through portion 222, so that the oil reservoir 199 can be rigidly attached to the engine.

The sound emanating from the one or more throttle bodies of the engine will be transmitted into the cavity 250 where it is surrounded by five hollow walls which are at least partially filled with oil. This provides significant attenuation of the noise generated from the throttle bodies.

Figure 9:
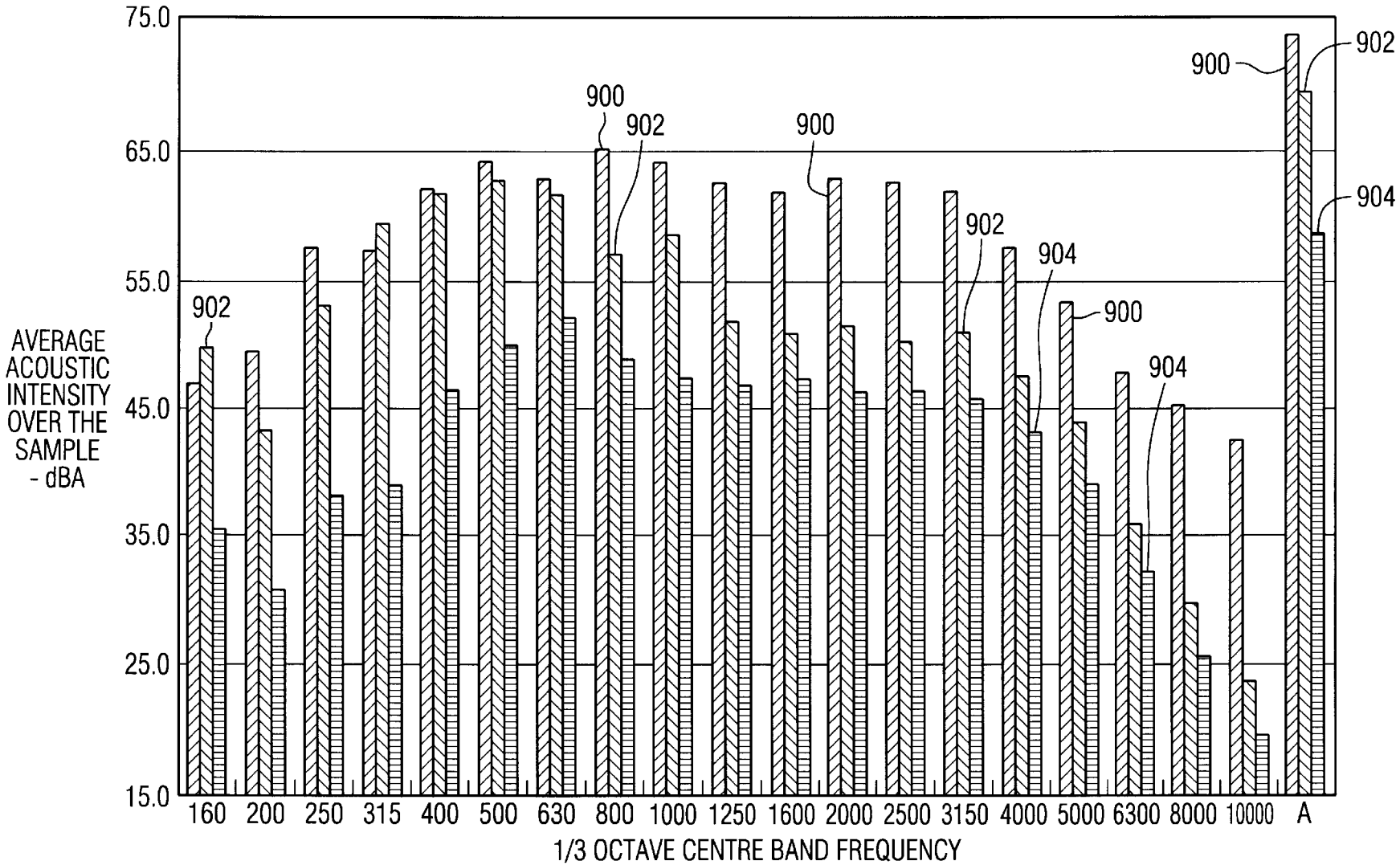
FIGS. 9, 10, and 11 represent graphical data empirically derived by simulating the effect of the present invention.
Figure 10:
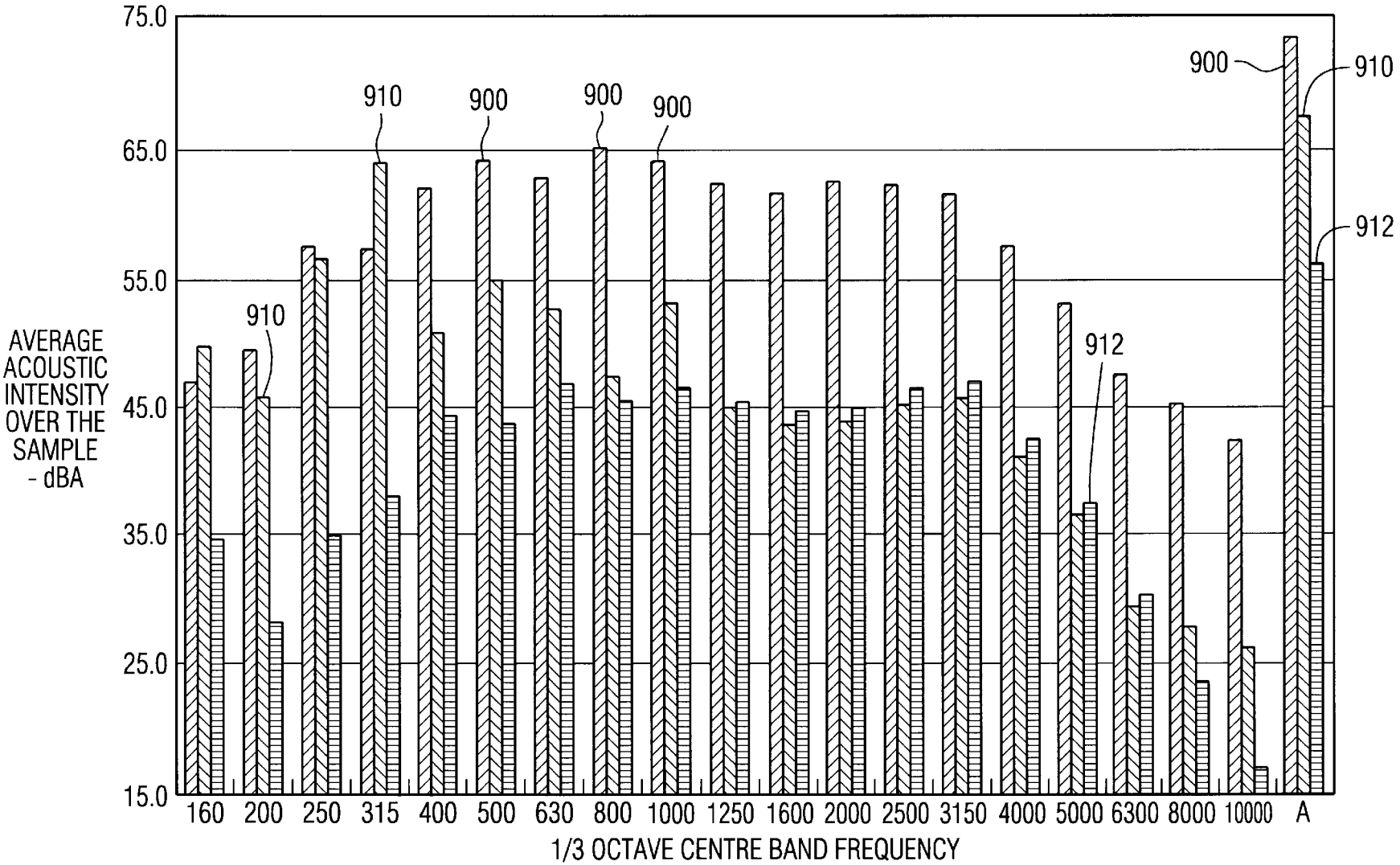
Figure 11:
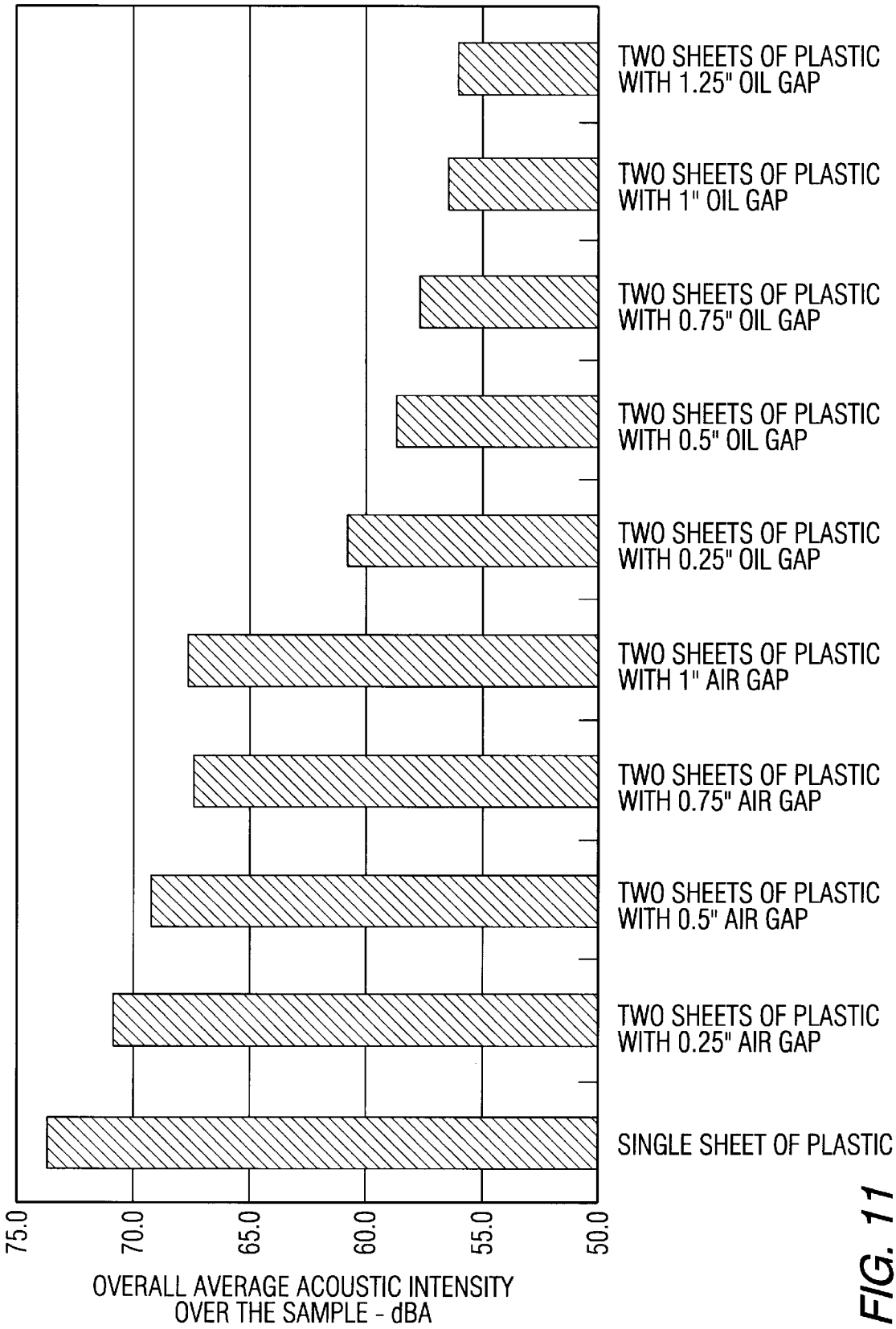

FIGS. 9, 10 and 11 graphically represent test data that was empirically derived from a simulation. The simulated tests were not actually performed on an outboard motor with an actual oil reservoir such as that shown in FIG. 8. Instead, the simulation used a reverberant box which consisted of a large box constructed with heavy sand-filled walls. Inside the box, a loudspeaker was used to broadcast high intensity "white noise" which has equal energy in each 1 Hz band. A port in the top of the box contained the samples which were rigidly mounted in a heavy frame. Initially, a single sample of oil tank material was tested by measuring the average acoustic intensity over the sample. The test was then repeated on a second sheet of material that was spaced from the first sheet by predetermined spacing. The test was then repeated, but with oil disposed between the two sheets of material. In FIGS. 9 and 10, sound measurements were taken at various one third octave center band frequencies under three different conditions. These three conditions are represented by the three bars that are grouped together at each of the selected frequencies. The leftmost bar in each grouping of three in both FIGS. 9 and 10 represents the average acoustic intensity over the sample for a single sheet of plastic. The center bar in each group of three in both FIGS. 9 and 10 represents the average acoustic intensity over the sample when two sheets of plastic were spaced apart with an air gap between. FIG. 9 represents an air gap of 0.5 inches and FIG. 10 represents an air gap of 1.0 inches. The rightmost bar in each group of three bars in FIGS. 9 and 10 represent the average acoustic intensity over the sample when two sheets of plastic were spaced apart with an oil gap therebetween. FIG. 9 represents an oil gap of 0.5 inches and FIG. 10 represents an oil gap of 1.0 inches. As can be seen, FIGS. 9 and 10 are very similar in the empirical data that they represent, except for the size of the gap between the two sheets of plastic represented by the center bars and rightmost bars in each group of three bars. FIG. 9 was performed with air and oil gaps of 0.5 inches and FIG. 10 was performed with air and oil gaps of 1.0 inches.

In both FIGS. 9 and 10, the rightmost group of three bars represents the overall average intensity for all frequencies.

Since the average acoustic intensity measurement is measured in decibels, which is logarithmic in scale, the height of each of the three bars in the average grouping to the right of FIGS. 9 and 10 represents the accumulated heights of their associated three bars in each of the frequency groupings of three bars each in the same figure.

With reference to FIGS. 9 and 10, the leftmost bars 900 in each grouping of three bars represents the average acoustic intensity measured over the area of a single piece of plastic under the conditions described above. The center bar 902 in each grouping of three bars in FIG. 9 represents the average acoustic intensity measured with two sheets of plastic spaced 0.5 inches apart with an air gap therebetween. The rightmost bar 904 represents the average acoustic intensity measured with two sheets of plastic spaced 0.5 inches apart and an oil gap therebetween.

In FIG. 10, the leftmost bars 900 represent the same data as the leftmost bars 900 in FIG. 9. However, the center bars 910 represent the average acoustic intensity measured across two sheets of plastic with a 1.0 inch air gap therebetween. The rightmost bars 912 in each group of three in FIG. 10 represents the average acoustic intensity measured across two sheets of plastic with a 1.0 inch oil gap therebetween.

With reference to FIGS. 9 and 10, it can be seen in FIG. 9 that the test results demonstrate that a full or an empty tank, represented by bars 904 and 902, respectfully, are very effective at reducing the intensity level at the higher frequencies which correspond to the most irritating components of noise emanating from the air induction system of an internal combustion engine. However, at some at the lower frequencies, the average acoustic intensity are only slightly improved. Adding oil between the plates had little additional beneficial at higher frequencies, as represented by bars 904, but offer dramatic improvement at the lower frequencies.

The results represented in FIGS. 9 and 10 demonstrate that the sound quality and sound level near an outboard motor can be significantly improved with a system that places oil filled hollow walls around the source of air induction noise, such as the throttle bodies of an internal combustion engine.

FIG. 11 is a graphical representation of the overall average acoustic intensity over the various samples tested in conjunction with the empirical tests described above. In decreasing overall average sound intensity, the bars in FIG. 11 show that the loudest circumstance is achieved with a single sheet of plastic used as a sound attenuator, such as used in the prior art. An improvement is represented by the second bar which represents two sheets of plastic with a 0.25 inch air gap therebetween. The third, fourth, and fifth bars in FIG. 11 show the gradual improvement when the air gap is increased to 0.50 inches, 0.75 inches and 1.0 inches. The sixth bar in FIG. 11 shows a dramatic improvement, even with a 0.25 inch gap, when oil is disposed between the plates to fill the gap. Further improvements are also shown in the seventh, eighth, ninth, and tenth bars in FIG. 11 which represent increasing gaps up to 1.25 inches with oil filling the gap between the plates.

When the preferred embodiment of the present invention, as illustrated in FIGS. 5, 6, 7 and 8 is used for these purposes, the significant benefits represented by bars 6, 7, 8, 9, and 10 in FIG. 11 can be achieved. This represents a significant and beneficial reduction in noise emanating from the air induction system of an engine. In addition, the present invention also provides an oil reservoir in the space normally used for a sound attenuator in known outboard motors. Therefore, in addition to reducing the required space under the cowl of an outboard motor, the present invention also provides a significant attenuation of noise emanating from the region of the throttle bodies, which are used as portions of either carbureted or fuel injected engines.

The present invention has been described with particular detail and specificity and illustrated to show one particularly preferred embodiment of the present invention. However, it should be understood that alternative embodiments are also within its scope. For example, the present invention provides five hollow walls and a plate member attached together in such a way so as to define a cavity 250 therein. Alternative configurations could be shaped to utilize more or fewer hollow walls while still embodying the basic principles of the present invention. Furthermore, the present invention as illustrated in FIGS. 5, 6, 7, and 8 is generally rectangular in its front view and is a parallelepiped in the isometric view of FIG. 8. It should be realized, however, that virtually any shape can be used. For example, generally cylindrical shapes, such as the basic shape of the flywheel cover described above, will also suit the intended purposes of the present invention and is therefore within its scope. It should also be realized that the throat of the throttle body need not be inserted entirely into the cavity 250. Instead, a portion of the throttle body can extend partially into the cavity 250 or remain completely outside the cavity, but disposed in proximate relationship with the air outlet opening 310. Furthermore, although it is preferable to have the hollow walls of the oil reservoir completely filled with oil, this is not always necessary or possible. When the hollow walls are partially filled with oil, a significant sound attenuating beneficial result can also be achieved. In fact, as illustrated in FIG. 11, even when the oil reservoir 199 is empty, the hollow walls filled with air have a sound attenuating effect that is beneficial, although not as beneficial as when the walls are filled with oil.

We claim:

1. A sound attenuation system for a sound producing machine, comprising:

a sound producing machine;

a localized sound producing region of said sound producing machine;

a liquid reservoir having a hollow wall shaped to receive and contain a quantity of liquid therein, said localized sound producing region being located between said sound producing machine and said hollow wall and also located between said sound producing machine and said quantity of liquid when said quantity of liquid is disposed within said liquid reservoir;

four hollow side walls attached to said hollow wall at the edges of said hollow wall; and a support bracket attached between said sound producing machine and said liquid reservoir.

2. The sound attenuation system of claim 1, wherein:

said four hollow side walls extend from said hollow wall in a direction toward said sound producing machine.

3. The sound attenuation system of claim 1, further comprising:

a plate member attached to said hollow wall to define a cavity therebetween.

4. The sound attenuation system of claim 3, further comprising:

an air inlet formed through said plate member through which ambient air can flow into said cavity.

5. The sound attenuation system of claim 4, further comprising:

an air outlet formed through said plate member through which air can flow from said cavity toward said localized sound producing region.

6. The sound attenuation system of claim 1, wherein:

said sound producing machine is an engine.

7. The sound attenuation system of claim 6, wherein:

said localized sound producing region is a throttle body of said engine.

8. The sound attenuation system of claim 7, wherein:

said liquid is oil and said liquid reservoir is an oil reservoir.

9. The sound attenuation system of claim 8 wherein:

said engine is a portion of a marine propulsion system.

10. The sound attenuation system of claim 9 wherein:

said marine propulsion system is an outboard motor.

11. The sound attenuation system of claim 10, wherein:

at least a portion of said throttle body extends into a cavity which is defined between a plate member which is attached to said hollow wall.

12. The sound attenuation system of claim 7, wherein:

said throttle body is part of a carburetor structure.

13. The sound attenuation system of claim 6, wherein:

said engine is a fuel injected engine.

14. A sound attenuation system for an internal combustion engine, comprising:

an engine;

a throttle body through which air can pass as it flows toward a combustion chamber located within said engine;

an oil reservoir having a hollow wall shaped to receive and contain a quantity of oil therein, said throttle body being between said engine and said hollow wall and between said engine and said quantity of oil when said quantity of oil is disposed within said oil reservoir; and four hollow side walls attached to said hollow wall at the edges of said hollow wall, said four hollow side walls extending from said hollow wall in a direction toward said engine.

15. The sound attenuation system of claim 14, further comprising:

a plate member attached to said hollow wall to define a cavity therebetween.

16. The sound attenuation system of claim 15, further comprising:

an air inlet formed through said plate member through which ambient air can flow into said cavity; and an air outlet formed through said plate member through which air can flow from said cavity toward said throttle body.

17. The sound attenuation system of claim 16, further comprising:

a support bracket attached between said engine and said oil reservoir.

18. The sound attenuation system of claim wherein:

at least a portion of said throttle body extends into said cavity.

19. The sound attenuation system of claim 14, wherein:

said engine is a fuel injected engine.

* * * * *